United States Patent [19]

Ottman et al.

[11] Patent Number: 4,466,218

[45] Date of Patent: Aug. 21, 1984

[54] FIXED ABRASIVE POLISHING MEDIA

[75] Inventors: John C. Ottman, San Jose, Calif.; John C. S. Shen, Rochester, Minn.

[73] Assignee: International Business Machines Corporation, Armonk, N.Y.

[21] Appl. No.: 474,864

[22] Filed: Apr. 22, 1983

Related U.S. Application Data

[62] Division of Ser. No. 260,549, May 4, 1981, Pat. No. 4,393,628.

[51] Int. Cl.[3] ..... B24D 11/00

[52] U.S. Cl. ..... 51/395; 51/295; 51/296

[58] Field of Search ..... 51/295, 296, 309, 395, 51/281 SF

[56] References Cited

U.S. PATENT DOCUMENTS

| | | | |
|---|---|---|---|
| 3,500,589 | 3/1970 | Ellege | 51/259 |
| 3,721,046 | 3/1973 | Dunn | 51/118 |
| 4,078,340 | 3/1978 | Klecker | 51/295 |
| 4,111,666 | 9/1978 | Kablow | 51/395 |
| 4,179,852 | 12/1979 | Barnett | 51/132 |
| 4,307,544 | 12/1981 | Balz | 51/295 |

*Primary Examiner*—Harold D. Whitehead
*Attorney, Agent, or Firm*—Robert W. Lahtinen

[57] ABSTRACT

The disclosure is directed to a method and apparatus for superfinishing magnetic disk substrates using a non-friable polishing pad including a high density polyurethane foam binder in which at least 50 per cent by weight of classified hard particles are retained. Polishing occurs by rotating the pad against the surface to be ultrafinished in the presence of a water soluable liquid vehicle maintaining a minimum pressure of 5 pounds per square inch at a rotational speed that achieves the desired aggressiveness of the polishing media. The method and apparatus contemplate both the ultrafinishing of newly prepared substrate disks and the restoring of previously coated disks to a ultrafinished substrate condition without producing substances or conditions toxic to the ecology or the operator.

6 Claims, 4 Drawing Figures

FIXED ABRASIVE POLISHING MEDIA

This is a division of application Ser. No. 260,549 filed May 4, 1981, now U.S. Pat. No. 4,393,628, issued July 19, 1983.

BACKGROUND OF THE INVENTION

This invention pertains to ultrafinishing metal surfaces and more particularly to the polishing of information handling disk metallic substrates.

As magnetic recording track densities and bit densities increase, it is necessary to enhance the precision of the accessing and transducer mechanism and the ability to discriminate between signal and noise with respect to the lesser magnitude signals being used. However, such technical achievements are unavailing if the cooperating storage media does not achieve similar higher levels of performance.

Such increased densities require that the media be formed of smaller magnetic particles disbursed in a thinner coating on a smoother substrate surface. The higher densities become even less tolerant of irregularities and discontinuities since smaller and smaller defects result in missing bits and unusable sectors or entire tracks.

The accepted finishing practice is to diamond turn the disk substrate which provides a relatively smooth planar surface which, although presenting a mirror finish, does include topography having a maximum peak to valley dimension that is 10 to 20 percent of the thickness of currently used coatings. This can cause signal irregularities which are tolerable, but when the coating thickness is reduced by half, localized thicknesses can be reduced by 20 to 40 percent by the substrate topography, which is unacceptable. To improve present media and enable the future use of thinner coatings, ultrafinishing of the diamond turned surface has become the practice. A common method is the use of a wax polishing pad and abrasive-laden slurry. This method improves the arithmetic average roughness of the surface, but does little to improve the maximum peak to valley differential. In addition, the abrasive particles are free to preferentially erode around the harder intermetallic sites at the substrate surfaces, often causing dislodging of such intermetallics and leaving pits.

SUMMARY OF THE INVENTION

In accordance with the present invention the disk substrate surface is ultrafinished after diamond turning using a semirigid, high density polishing pad of polyurethane foam impregnated with classified hard particles in excess of 50 percent by weight. This is a fixed abrasive polishing pad with the classified hard particles ideally of 1 micron size and not exceeding 5 microns. Since even the 1 micron particles are 40 micro inches in size and the finishing operation is undertaken to reduce the size of 6 to 10 micro inch topographical irregularities, it is imperative that abrasive particles are locked into fixed circular travel paths, disallowing preferential erosion. It is important that the particles be captured as a fixed abrasive by the polyurethane binder and gradually disintegrate during the polishing process rather than breaking away from the binder.

The polishing process occurs with the substrate vertically positioned for rotation about a horizontal axis and the polishing pads mounted about a parallel axis and positioned to cause the pad surface to rotate upon the substrate surface to be polished. The polishing occurs in the presence of a low viscosity water soluable liquid vehicle. This process enables the ultrafinishing of the substrate surface to reduce maximum peak to valley dimensions to 25 percent of that present following the diamond turning operation.

During the polishing procedure pressure between the polishing pads and the disk substrate is applied by the right spindle as viewed in FIG. 4 which includes the bellows element. The spindles slide together according to a preset instruction upon initiation of the cycle. The vehicle is added through a spray nozzle. During the polishing process the spray nozzle applies a predetermined quantity of vehicle to the polishing area periodically. The liquid vehicle is applied between the polishing pads at the inner diameter of the disk.

The polishing is done by rotating the polishing pads at a speed of 300 RMP while applying a pressure of 7 pounds per square inch between the polishing pad and substrate. The polishing cycle is continued for two minutes during which 100 milliliters of liquid vehicle is applied using 10 injections.

The minimum polishing pressure found to be effective is 5 pounds per square inch and as the rotational speed of the polishing pads is increased, the pressure must also be increased to maintain polishing effectiveness. As the rotational speed and pressure are increased the aggressiveness of the polishing pads also increases.-Polishing speeds above 300 RPM are not commonly used.

The use of this polishing pad and the described technique does not impregnate the surface of the substrate with polishing debris that would require a subsequent solvent rinse for its removal. The process tolerates less stringent diamond turning specifications, and the polishing does not use or terminate with a residue of chemicals that are dangerous either to the operators or the ecology. Further the use of the liquid vehicle without abrasive particles avoids clogging or damaging of the machine lines or nozzles, avoids the use of a separator tank and makes unnecessary the agitation of a mixture of liquid and particles at each machine.

The polishing technique and the polishing pads of this invention are also used in reclaiming disk substrates from disks wherein the subsequent coating has been done, but found inadequate and the disk therefore rejected. Because of the complex operations and the strict specifications, there is a high rejection rate of finished or coated disks. Commonly about one-third of the finished disks fail to meet the required specifications, and the finished substrate represents about one-half of the final cost of a finished disk with the magnetic ink coating.

A significant savings can be realized by the ability to restore the rejected, coated disk to a finished substrate condition rather than to scrap the rejected disk media. The reclaiming of disk substrates has a further benefit, since the diamond turning operation is the most limiting operation in the entire sequence of disk processing operations. Accordingly, if the one-third of the production that fails to attain specifications is reclaimed, the production capability can be effectively increased by 50 percent.

It is an object of this invention to provide an apparatus for ultrafinishing magnetic disk substrates to produce both an improved arithmetic average roughness and minimize the maximum dimension of surface asperities without dislodging them via preferential erosion. It is also an object of this invention to provide a polishing apparatus that can be used with existing polishing equipment. It is also an object of this invention to provide an apparatus to effectively restore coated disks to a precoated, ultrafinished substrate surface as well as producing a ultrafinish on newly diamond turned disk substrates. It is a further object to provide a substrate polishing apparatus that in use does not produce conditions or substances that are toxic to either the ecology or the operator.

DETAILED DESCRIPTION

Figure 1:
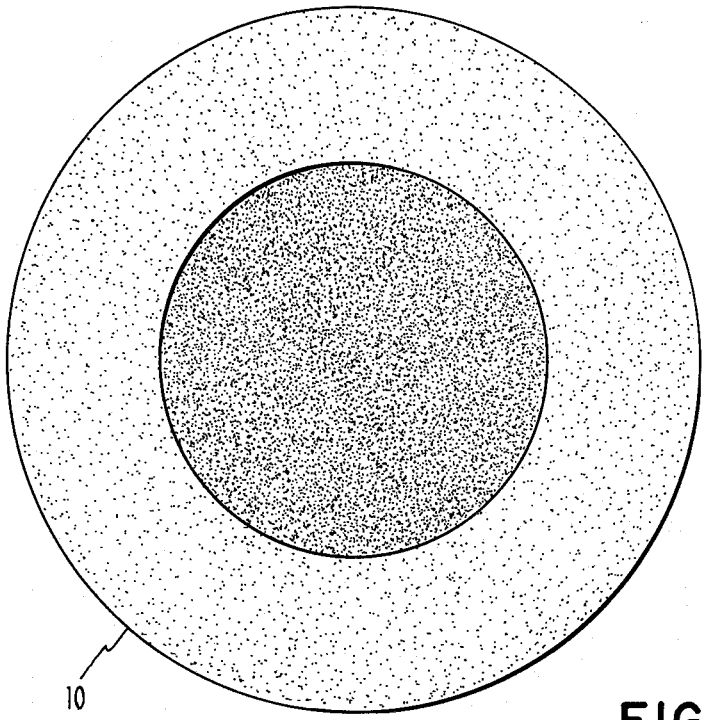
FIG. 1 is a view of the polishing surface of a polishing pad formed in accordance with this invention.
Figure 2:
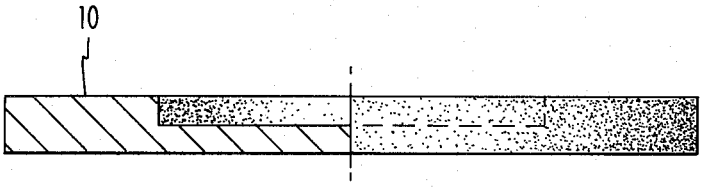
FIG. 2 is a section view of the polishing pad of FIG. 1.

The polishing pad 10 of FIGS. 1 and 2 is a high density, abrasive element of abrasive particles in a polyurethane binder formed in a closed mold. A surfactant is used to enable the use of a higher concentration of abrasive material in the resulting polishing pad.

Representative polishing pad formulations are found in the following examples:

| | Ingredient | Parts By Weight |
|---|---|---|
| Example 1 | Polyisocyanate | 50.0 |
| | Polyesterpolyol | 50.0 |
| | 1 Micron $Al_2O_3$ | 100.0 |
| | Blowing Agent ($H_2O$) | 0.5 |
| | Silicon Surfactant | 1.0 |
| | Tertiary Amine Catalyst | 0.8 |
| Example 2 | Polyisocyanate | 30.0 |
| | Polyesterpolyol | 70.0 |
| | 1 Micron $Al_2O_3$ | 100.0 |
| | Fluorocarbon Freon TF | 10.0 |
| | Silicon Surfactant | 1.0 |
| | Catalyst | 0.6 |

The composition may be varied from 30 parts polyisocyanate and 70 parts polyesterpolyol to 60 parts polyisocyanate and 40 parts polyesterpolyol. Also the abrasive content may be within the range of 100 to 200 parts by weight, which concentration is made possible through the use of a surfactant. The abrasive content is thereby in the range of 50 to 65 percent by weight. The abrasive may be aluminum oxide with particle sizes of 1 micron to 5 microns, but best results are obtained when the particle size is limited to 1 micron.

The above component materials (with the exception of the catalyst) are mixed together for about 1 minute or until a uniform mixture is achieved. After introducing the catalyst the material is mixed for 10 seconds and placed in the closed mold. The mixture is cured in the mold for 20 minutes at a temperature of 400 degrees Fahrenheit.

After the polishing pads have been formed the polishing surface is machined to remove the surface skin. The completed polishing pad has a density of 45 to 55 pounds per cubic foot and a hardness of 45 to 60 durometer, D-scale.

Figure 3:
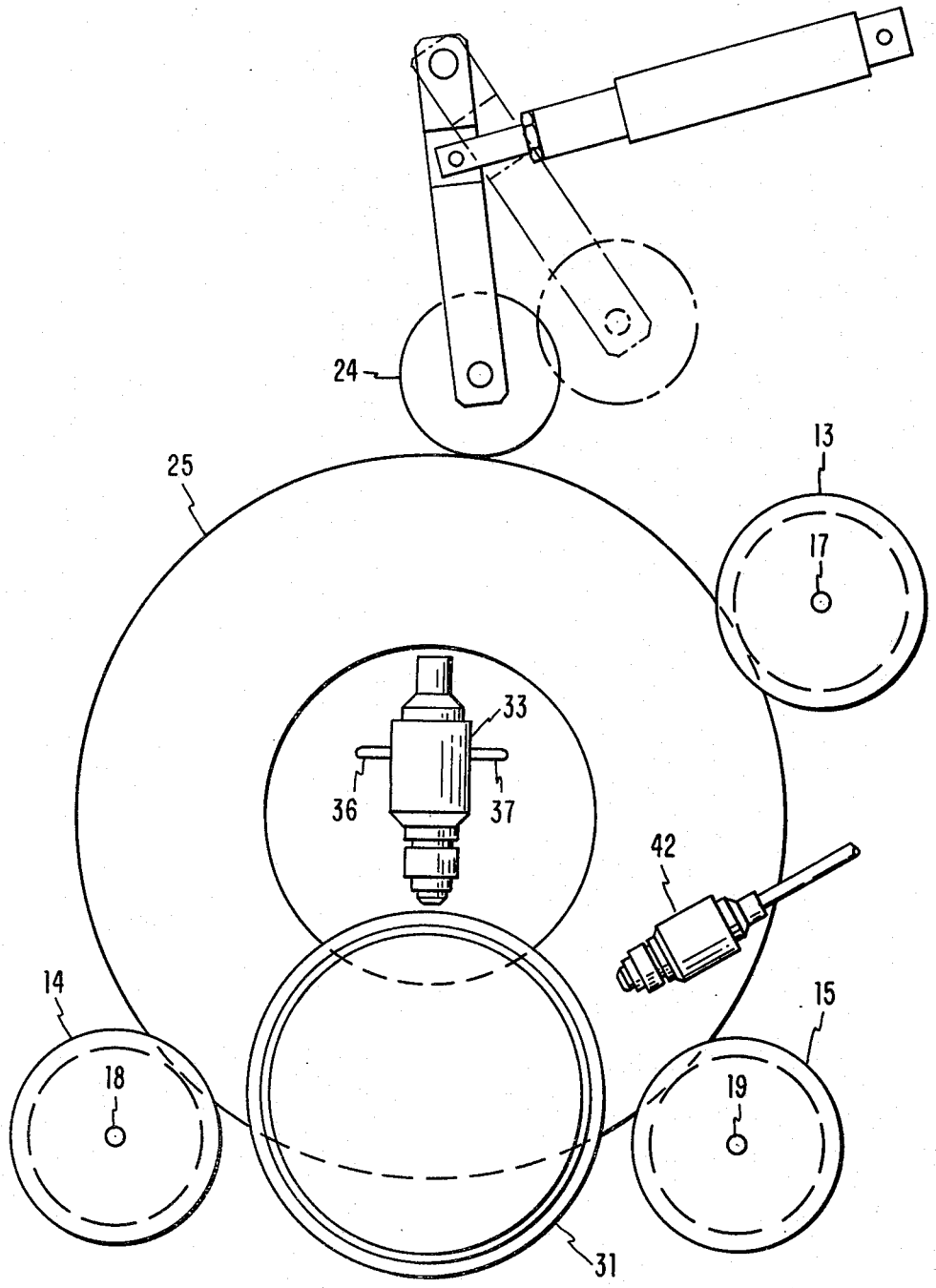
FIG. 3 is a schematic, partial side elevation of a polishing machine for using the polishing pad and practicing the method of this invention.
Figure 4:
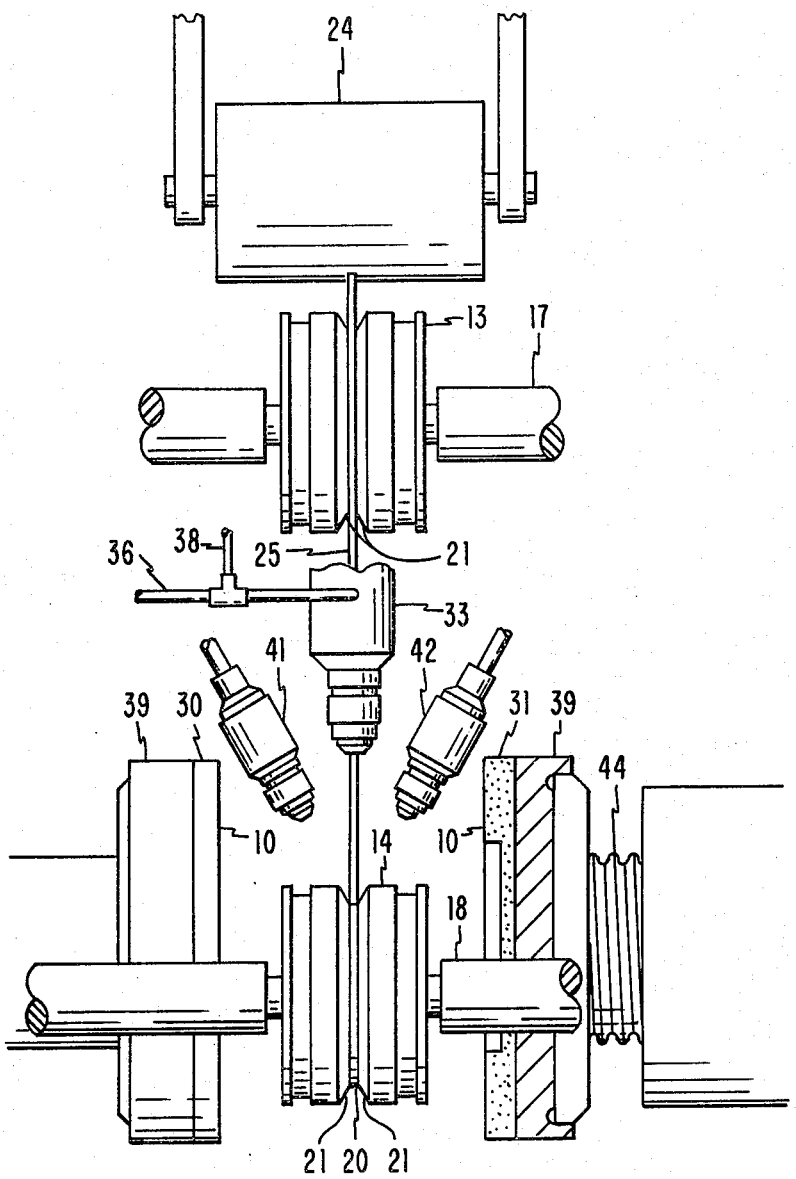
FIG. 4 is a front elevation of the polishing machine elements of FIG. 3.

FIGS. 3 and 4 schematically show a typical polishing machine wherein a disk substrate is supported by a pair of fixed axis idler rolls 13, 14 and a fixed access drive roll 15, each of which is movable along the axis of the respective supporting shaft 17, 18, 19 and has a disk engaging roll surface 20 and a pair of disk confining flanges 21. The disk substrate is confined in the polishing position by a pivoted idler roll 24 that is supported on a frame for pivotal motion toward and away from a disk substrate mounted in the device.

Drive roll 15 is mounted on driven shaft 19 to inpart rotation to a disk substrate mounted in the machine at a speed which is a function of the rotational speed of shaft 19 and the effective diameter of roll 15. The connection of roll 15 to shaft 19 is in the form of an overrunning clutch which permits shaft 19 to continuously drive at a given rotational speed, but allows roll 15 to freely rotate faster if a higher rotational speed is imparted to the disk substrate-workpiece by another source. Accordingly, during a cycle of machine operation the substrate is rotated by the driving engagement of roll 15 when the polishing pads are disengaged. However, when the polishing pads are engaged, the polishing pad rotation induces a higher rotational speed of the disk substrate-workpiece than available from drive roll 15, and accordingly during the polishing portions of the machine cycle disk rotation is induced solely by the driving contact of the rotating polishing pads.

A disk substrate 25 to be polished is placed in the machine of FIGS. 3 and 4 and prior to the polishing process is rinsed using deionized water. During this preliminary step the disk is rotated by the drive roll 15. Although during the polishing operation, the drive roll 15 continues to act as a driver, the rotation of the disk substrate work piece 25 is imparted primarily by the rotation of polishing wheels 30, 31 that rotate in engagement with the substrate.

The vehicle for the polishing process is supplied through a nozzle 33 which as shown, is positioned in the plane of the disk substrate work piece 25 in the central circular opening. The liquid vehicle is supplied through tube 36 to nozzle 33 and air is received at the nozzle through tube 37. When it is desired to apply another liquid to the disk substrate suface, such as a soap solution or detergent as described hereafter, the material is introduced using the same nozzle 33 and supplying the liquid through the line 38. Another pair of nozzles 41 and 42 are mounted to spray liquid on the substrate-workpiece surface being polished. These nozzles 41 and 42 spray deionized water on the substrate surface to provide a rinse cycle portion as described in the polishing process sequence. The polishing pad of FIGS. 1 and 2 is mounted on a rigid plate 39 by any suitable means. This may be accomplished by an adhesive such as epoxy, not wax, hot glue or through the use of two-sided adhesive tape. The polishing pad assembly is secured to an end plate 40 which is mounted on the machine to permit rotation and axial advance and retraction. In operation both polishing pad support assemblies are axially advanced toward the disk substrate 25 to the operative position. The polishing pad support and drive assembly includes a pneumatic bellows section 44 into which air is introduced to apply a predetermined polishing force. This provides universal self-adjustment for maintaining the proper disk-to-pad relation during polishing. The polishing process used incorporates the vertical polishing technique using a device such as shown in FIGS. 3 and 4. The polishing machine uses polyurethane foam abrasive-impregnated polishing pads and a water soluble solution as a vehicle. The vehicle helps to remove debris, protect the work piece or subject of the polishing, and prevent loading or clogging of the work piece surface.

The aluminum substrate surface is relatively soft compared to other metals and therefore must be treated with care. The polishing pad although rigid in construction has enough resilience or elasticity to allow the harder abrasive particles to remain lodged in place. Instead of abrasive particles floating freely and preferentially eroding the aluminum disk, the abrasive particles adhere to the polishing pad and slowly deteriorate during the polishing process.

The vehicle used in the polishing process consists of amonium lauryl sulfate (with citric acid added), water soluable glycol surfactant and deionized water. This combination allows complete wetting of the polishing surface. It is also low in viscosity allowing a slick working surface.

The polishing process includes variables such as the time duration of the process, contact pressure between polishing pad and substrate, rotational speed of the polishing pads and the application of the liquid vehicle. The contact pressure required is 5 pounds per square inch (psi) minimum with an optimum value at approximately 7 psi. The rotational speed determines the aggressiveness of the polishing media. For ultrafinishing the substrate surface 300 revolutions (RPM) has been found to be optimum at a 7 psi contact pressure. If a more aggressive material removal is required the speed may be maintained at 300 RPM and the contact pressure increased. The liquid vehicle is applied during the polishing cycle periodically. In reclaiming disks by the removal of previously applied coating material it is advantageous to apply the vehicle prior to the polishing in addition to the application during the polishing step.

The typical polishing process involves the advancement of the polishing pads to a location approaching engagement with the substrate to be polished. The pressure to be maintained during the polishing step is established and maintained by controlling the air pressure applied to the bellows 44 of FIG. 4. The polishing wheels 30, 31 are rotated at 300 RPM for a period of two minutes during which a contact pressure of 7 psi between the polish pad and substrate-work piece is maintained. The vehicle is applied to the surfaces being polished through nozzle 33 by dispensing 10 injections of 10 ml. each every 12th second.

There is a relationship between contact pressure and rotational speed. The polishing can be accomplished using decreased rotational speed and increased contact pressure. For example, if the speed is reduced to 90 RPM and the contact pressure increased to 25 psi, the polishing can be accomplished without other parameter changes.

Another use of the polishing process is to restore a disk which has an unsatisfactory coating of magnetic material to the uncoated, polished condition immediately prior to the coating process. This involves the removal of the surfacing material or magnetic ink which normally is less than 40 microinches thick at the inner diameter where the thickness is greatest. Thus on a 75 mil substrate the accumulated thickness of the coating on both sides is approximately one thousandth of the total thickness of the coated disk.

The process for reclaiming a previously coated disk involves a 3 minute polishing period which is broken into 2 different phases, both of which are preceded and followed by rinse cycles. The initial polishing phase is used for removal of the coating. It features periodic, separate ejections of vehicle and a soap solution. The second phase is for regeneration of the substrate surface to ultrafinish quality and, except for the initial few seconds during which a small amount of the soap solution is applied, only vehicle is used.

In a typical rework process the disk is first rotated for 5 seconds by the drive roller while being spray-rinsed with deionized water. The polishing pads then converge against the disk with a surface pressure of 5.5 PSI and a rotary speed of 300 RPM. Aggressive polishing takes place for 60 seconds as vehicle and soap solutions are metered as follows:

Soap solution— 6 ejections of 5 ml. each, 1 every third second during the initial 18 seconds at a rate of 8 milliliters per second Vehicle— 20 ejections of 10 ml. each, 1 every third second during the entire 60 seconds at a rate of 8 milliliters per second.

The polishing pads then retract and another deionized water rinse takes place for 15 seconds as the drive roller continues to rotate the substrate.

The polishing pads reconverge against the substrate with the same pressure and rotary speed as in the previous phase. Polishing is resumed for 120 seconds as vehicle and soap solutions are metered as follows:

Soap solution— 2 ejections of 5 ml. each, 1 at the third second and 1 at the sixth second only.

Vehicle— 40 ejections of 10 ml. each, 1 every third second during the entire 120 seconds.

The final rinse then is applied for 15 seconds with the polishing pads retracted and the drive roller continuing to rotate the disk.

A typical vehicle used during the polishing cycle portions of the polishing process is the following water soluble solution:

| Constituent | Parts By Volume |
|---|---|
| Water soluable glycol | 11.25 |
| Amonium lauryl sulfate (with citric acid added) | 5.00 |
| Deionized water | 83.75 |

An example of the soap solution used in the disk reclaiming polishing process is formulated as follows:

Dissolve 100 grams of dry castile soap in 1 liter of 80% alcohol (4 parts alcohol to 1 part deionized water). Allow to stand several days and dilute with 70% to 80% alcohol until 6.4 milliliters produces a permanent lather with 20 milliliters of standard calcium solution. The lather solution is made by dissolving 0.2 grams of $CaCo_3$ in a small amount of dilute HCl, evaporating to dryness and making up to 1 liter.

An alternative form of the polishing pad is achieved by using 1 micron diamond particles as the hard particles held captive in the high density polyurethane binder. Using these particles rather than aluminum oxide, the pad is configured as a thin molded annulus which is secured to a supporting pad in composite fashion as opposed to the single piece structure illustrated in FIGS. 1 and 2. Although the polishing pad formed using diamond particles is much more expensive, this disadvantage may be offset by the increased production that can be achieved. Using aluminum oxide particles approximately 1400 disk surfaces can be polished before it is necessary to dress or refinish the polishing pad surface whereas with a diamond particle pad it is possible to polish approximately 8,000 disk surfaces before resurfacing. Accordingly, such refinishing occurs 5 to 6 times more frequently when using the more economical aluminum oxide particles.

While the invention has been particularly shown and described with reference to preferred embodiments thereof, it will be understood by those skilled in the art that the foregoing and other changes in form and details may be made therein without departing from the spirit and scope of the invention.

Having thus described my invention, what is claimed as new and desired to be secured by letters patent is:

1. A non-friable, fixed abrasive polishing pad comprising:

50 to 70% by weight of classified hard particles not exceeding 5 microns in size which have been treated with a silicon surfactant and are retained in a binder of polyurethane foam formed in a closed mold to produce a part having a hardness of 30 to 60 durometer, D-scale.

2. The polishing pad of claim 1 wherein said hard particles are $Al_2O_3$ and such particles do not exceed 1 micron in size.

3. A fixed abrasive polishing pad comprising:

50 to 70% by weight of uniformly disbursed, classified abrasive particles treated with a silicon surfactant in a resilient elastomeric polyurethane-polyester foam having a D-scale durometer hardness of 45 to 60 and a high tensile strength with a non-friable characteristic.

4. The polishing pad of claim 3 wherein said abrasive particles are $Al_2O_3$ particles not exceeding 1 micron in size.

5. The polishing pad of claim 4 wherein said polyurethane-polyester foam comprises 30 to 60% by weight of polyisocyanate and 70 to 40% by weight of polyester-polyol.

6. The polishing pad of claim 3 wherein said classified abrasive particles are diamond particles not exceeding one micron in size.

* * * * *